US006666342B1

(12) United States Patent
House

(10) Patent No.: US 6,666,342 B1
(45) Date of Patent: Dec. 23, 2003

(54) LOCKABLE RAILING TROUGH

(75) Inventor: Robert D. House, Peoria, AZ (US)

(73) Assignee: H/T Fabricators, LLC, Peoria, AZ (US)

( * ) Notice: Subject to any disclaimer, the term of this patent is extended or adjusted under 35 U.S.C. 154(b) by 0 days.

(21) Appl. No.: 10/299,125

(22) Filed: Nov. 18, 2002

(51) Int. Cl.[7] ..... A47F 5/00

(52) U.S. Cl. ..... 211/70.6; 211/86.01; 211/88.01; 182/129; 248/214

(58) Field of Search ..... 211/70.6, 88.01, 211/86.01; 182/129; 248/214

(56) References Cited

U.S. PATENT DOCUMENTS 3,325,038 A * 6/1967 Ferney
3,986,649 A * 10/1976 Heimstra ..... 211/85.01 X
4,357,881 A * 11/1982 De Long ..... 211/88.01 X
4,401,222 A 8/1983 Kulikowski et al.
4,480,810 A * 11/1984 Hall ..... 182/129 X
4,676,468 A 6/1987 Preston et al.
4,706,918 A * 11/1987 Wilson ..... 182/129 X
5,429,205 A * 7/1995 Collins
5,469,999 A 11/1995 Phirippidis
5,547,080 A 8/1996 Klimas
5,803,422 A * 9/1998 Buehler ..... 248/215 X
5,876,009 A 3/1999 Simoncioni, Jr.
6,095,057 A * 8/2000 Corban
6,170,680 B1 * 1/2001 Hung ..... 211/119.007
6,412,601 B1 * 7/2002 Schmidt ..... 182/129
6,467,744 B1 * 10/2002 Calin ..... 248/214

* cited by examiner

*Primary Examiner*—Robert W. Gibson, Jr.
(74) *Attorney, Agent, or Firm*—Schmeiser, Olsen & Watts LLP

(57) ABSTRACT

The present invention is to a lockable railing trough. The railing trough may have end panels, forming a bin. The locking mechanism comprises a mechanically separate item from the trough. The trough or bin may be hung on a railing, perhaps on a man lifter, by a hook portion of the trough or bin and locked there with the locking mechanism, which engages the trough or bin and not the railing. The trough or bin may hang on the inside of the railing or on the outside of the railing. Matched pairs of troughs and/or bins may be arranged in saddle-bag fashion, with their hook portions overlapping over the railing. A plurality of bins and troughs may be used on a plurality of railings on a single man lifter. The bins and troughs may be adapted to particular work environments such as painting, electrical work, or plumbing. The troughs and bins may comprise compartments, trays, tool tethers, and other adaptations to particular work requirements.

38 Claims, 12 Drawing Sheets

LOCKABLE RAILING TROUGH

BACKGROUND OF THE INVENTION

1. Technical Field

This invention relates generally to devices for holding parts and tools in a temporary work place and more specifically to holding parts and tools within easy reach of a person working on a man lifter, cherry-picker, or other isolated platform with railings.

2. Background

Man lifters elevate a workman and the tools and parts needed to do a job. Elevations of ninety feet or more may be obtained. The man lifter work space conventionally includes a floor, or platform, surrounded with a railing. Persons working on man lifters and other confined, isolated, elevated platforms conventionally must carry their tools and parts on their person or lay the tools and parts on the floor of the man-lifter. Carrying parts and tools on the person may be impossible for large jobs and is at least fatiguing for medium-sized jobs. Having parts and tools on the man lifter floor is dangerous to the worker who may trip on such items and to those below the platform who may be struck by falling metal parts and tools. Furthermore, having parts and tools on the floor is inefficient due to the time spent bending over to pick them up. The difficulties do not appear to have been addressed in the existing art.

A tool box for scaffolding is known in the art. U.S. Pat. No. 5,547,080 to Klimas (1996) discloses a tool box with a lid, the box adapted to hang on a scaffolding bar and required to be supported against rotation by at least one vertical scaffolding bar. Klimas discloses locking the lid of the tool box, but not locking the tool box to the scaffolding. A portable carrier device that attaches to ladder rungs and stiles is known in the art. U.S. Pat. No. 4,676,468 to Preston, et al. (1987), discloses a device that hooks over and clamps to a ladder rung and also engages a ladder stile for stability. Preston does not disclose a lock for securing the carrier to the rung or stile.

Neither of these devices nor other conventional methods meet all the needs of those who work on elevated, isolated platforms such as man lifters, cherry pickers, boom-lifts, and other railing-delimited platforms. The workman needs the means to secure tools and parts in a convenient location while ensuring that parts and tools are unlikely to fall off the mobile man lifter. At the same time, the means for carrying tools and parts must not imbalance the man lifter, as a large tool box may do if placed outside the man lifter railing.

SUMMARY OF THE INVENTION

Accordingly, the present invention is to a lockable railing trough for holding tools and parts for a workman in a railing-delimited work space, such as on a man lifter, cherry picker, scaffolding, or boom lifter. The railing trough may have end panels, forming a bin. The locking mechanism comprises a mechanically separate item from the trough. The trough or bin may be hung on a railing, as on a man lifter railing, by a hook portion of the trough or bin and locked there with the locking mechanism, which engages the trough or bin. The trough or bin may hang on the inside of the railing or on the outside of the railing. Matched pairs of troughs and/or bins may be arranged in saddle-bag fashion, with their hook portions overlapping over the railing. A plurality of bins and troughs may be used on a plurality of railings on a single man lifter. The bins and troughs may be adapted to particular work environments such as painting, electrical work, or plumbing. The troughs and bins may comprise compartments, partitions, trays, tool tethers, and other adaptations to particular work requirements.

BRIEF DESCRIPTION OF THE DRAWINGS

The foregoing and other features and advantages of the lockable railing trough will be apparent from the following more particular description of specific embodiments of the lockable railing trough, as illustrated in the accompanying drawings, wherein.

DETAILED DESCRIPTION OF EMBODIMENTS OF THE INVENTION

Figure 1A:
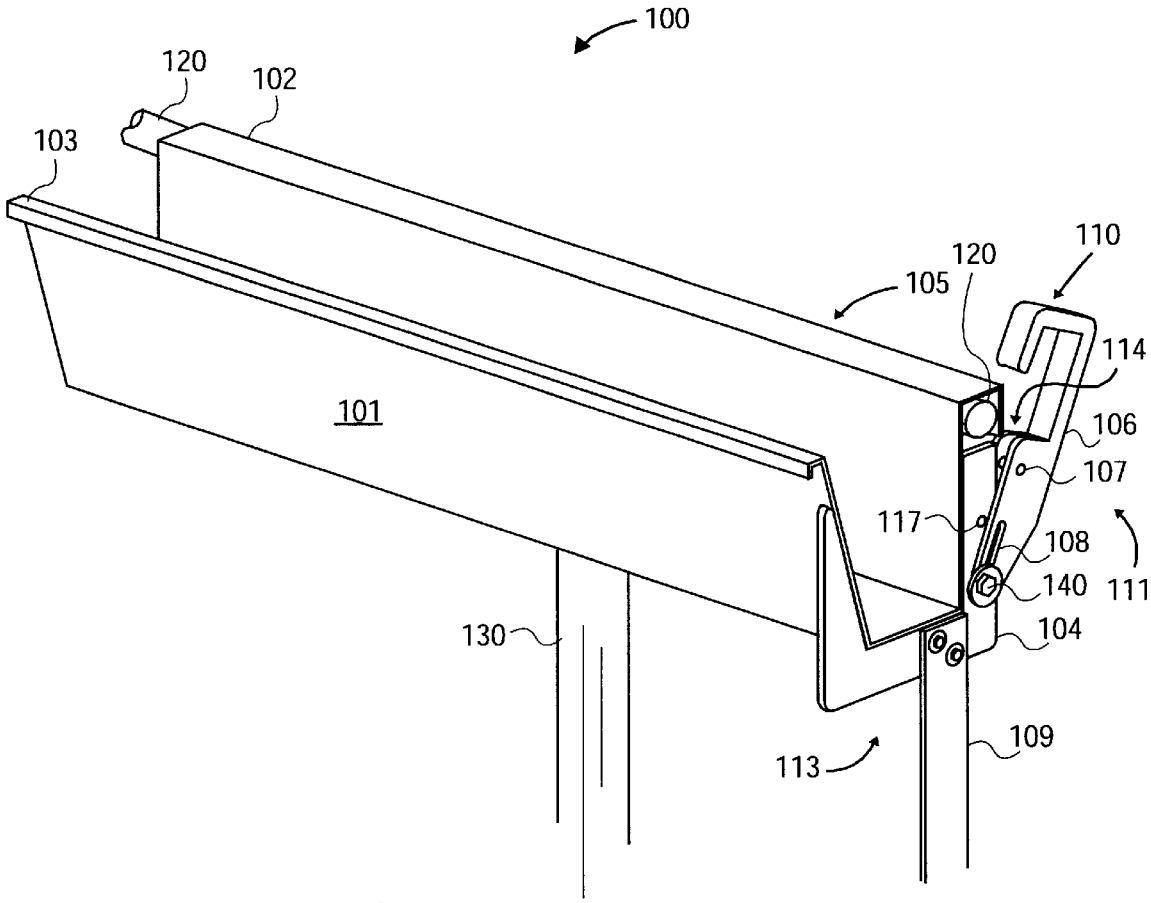
FIGS. 1A–D depict an exemplary embodiment of the lockable railing trough in four different positions.

Referring now to FIG. 1A, lockable railing trough 100 comprises a trough 105 and a lock 113. Trough 105 may be a single sheet of bent metal, such as aluminum. Any substantially rigid material with sufficient strength may be used for forming trough 105. For example, fiberglass, plastics, or boron-epoxy composites, which may be formed or molded to shape, may be particulary useful where weight is critical. For further examples, metal troughs may be bent to shape in a machine adapted to the purpose, cast, or stamped. In some embodiments, trough 105 may be assembled from parts of a plurality of materials. Trough 105 comprises a hook portion 102 and a container portion 101. The hook 102 may extend substantially the full length of the container 101 and is sized and shaped to fit over railing 120. In an alternate embodiments, the hook 102 may extend discontinuously in short sections along a container length. The hook 102 is shown as a squared off hook 102 but, in other embodiments, may be rounded or otherwise adaptively shaped to a particular railing shape and size. Container 101 comprises a bottom, a first side at approximately right angles to the bottom, and a second oblique side. Other shapes and angles are also contemplated.

The hook 102 extends from the first side of the container 101, over the railing 120, and downward by approximately the entire vertical dimension of the railing 120. The extent of the downwardly-extending portion of the hook 102 fits with the lock 113 to ensure that any gap between the hook 102 and the closed lock 113 is too small to permit railing 120 to escape. Suspended on the railing 120, the hook 102 engages the railing 120 at several points. For example, a round railing 120 contacts the top and one or two side interior surfaces of the hook 102. IN some embodiments, the lock 113 is configured to prevent the railing from simultaneously contacting the lock 113 and all of the interior surfaces of hook 102 contacted in suspension. Thus, the lock 113 will normally contact the railing 120 only in response to some upward impulsive force on the lockable railing trough which would disengage the hook 102 from the railing 120 were it not for the lock. That same force will cause railing 120 to break contact with at least the top interior surface of the hook 102.

The oblique second side of container 101 serves to gravitate loose parts and pipes closer to the railing 120, thereby reducing how far outboard the workman must reach for a part. In a particular embodiment for a trough mounted outside of a railing, the bottom of the trough may narrow almost to the point of disappearing. For greatest ease of use, the bottom should be about an inch wider than the diameter of pipe or conduit usually carried in the trough. This leaves room for a workman's fingers to get underneath the pipe or conduit.

In some embodiments, interior surfaces of the container 101 and the hook 102 may be finished or coated to increase frictional forces. For example, a neoprene coating may be used to increase frictional engagement between the container 101 walls and parts, such as electrical conduit, laying in the trough 105.

Trough 105 may further comprise a lip 103. Lip 103 comprises a doubly bent portion of the trough 105. Lip 103 may serve as a handle and for other purposes. For example, for an embodiment adapted to painting, lip 103 may engage one edge of a drop cloth, perhaps with clamps, that extends under a vertical surface to be painted, thereby preventing paint drips from falling to the floor below. The invention contemplates that trough 105 may be made in a wide variety of cross-sectional shapes, although only one shape is illustrated. In some embodiments, the lip 103 may bend inward, toward the container 101.

Because of its open ends, trough 105 is particularly useful for long items. For example, an electrician may use a trough 105 that is six feet long to hold lengths of electrical conduit that are conventionally ten feet long. The first side of trough 105 may contact vertical railing support 130 to prevent rotation of the trough about the railing 120, but this is not necessary. The railing 120 and railing supports 130 are not part of the present invention. Alternatively, caps may be added to the ends of the trough 105 or the ends otherwise enclosed to prevent smaller items from falling out.

In the exemplary embodiment depicted in FIG. 1A, lock 113 comprises a support 104 which is adapted to fit around and engage by contact the bottom and portions of the sides of the container 101. A portion of the support 104 may be adapted to align beneath the hook 102 when the lock 113 is engaging the trough 105. The top edge of the under-hook portion of the support 104 is approximately level with the bottom of the hook 102. The support 104 need not contact the railing 120, and normally does not unless the railing trough 105 is subjected to a mechanical shock. Lock 113 may be used with the trough 105 on any railing 120 that will fit within the hook 102. Because the design of lockable railing trough 100 makes the shape of the railing 120 irrelevant, the lockable railing trough 100 is highly portable between railing-delimited workspaces of different designs. Furthermore, because the lockable railing trough 100 requires only a railing 120 and perhaps a man-lifter floor edge 720 (FIG. 7) for support, the lockable railing trough 100 is portable between all railing-delimited workspaces having a railing 120.

The under-hook support portion of support 104 may have a slider pin 140 attached to engage the slider slot 108 of the catch 111. While so engaged, the catch 111 may rotate about the slider pin 140 and translate within the limits of the slot 108. In embodiment 100, the slider pin 140 may be a bolt 140. As shown in FIG. 1A, the catch 111 is about to be rotated into alignment with the hook 102. In making catch 111, the opening below the point of catch hook 110 must be large enough to receive hook 102, and the crook of catch hook 110 must be wide enough to engage hook 102. Catch 111 may have a locking pin bore 107 through the body 106 of the catch 111. In embodiment 100, the body 106 may include a channel 114 between two flanges of body 106, as shown. The channel 114 is wide enough to slidingly receive the thickness of support 104. Locking pin bore 107 may extend through both flanges. Likewise, each flange may have a slider slot 108 to receive a slider pin 140 on each side of support 104. In the closed position (FIG. 1C), locking pin bores 107 align with locking pin bore 117 in the support 104 to receive a locking pin 150 (FIG. 1C). In some alternate embodiments, the catch 111 may be spring-biased in the closed position.

Figure 7:
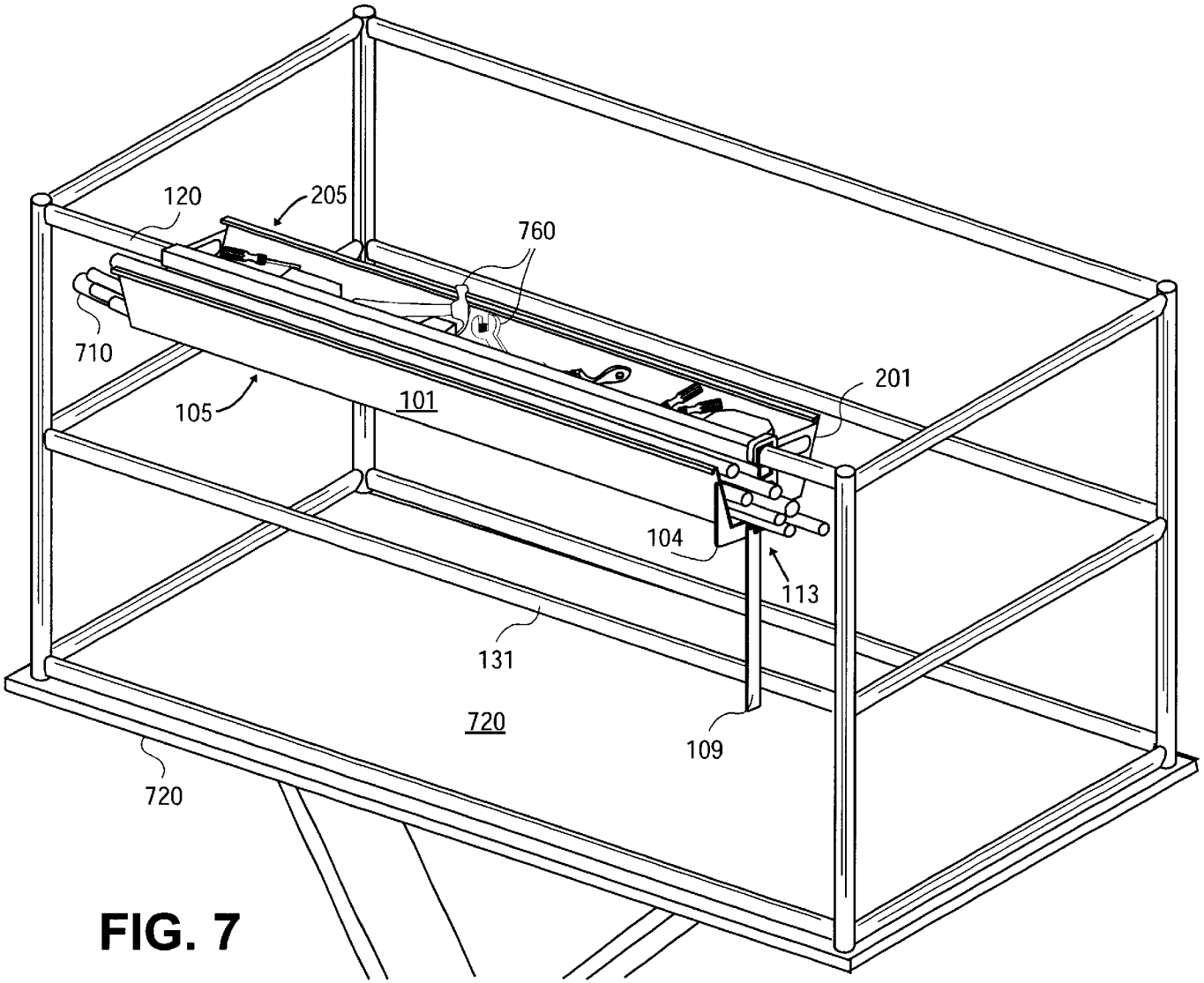
FIG. 7 depicts an exemplary bin and trough embodiment of the lockable railing trough in place on a man-lifter.

Lock 113 may further comprise brace 109 which may be attached to support 104. The brace 109 extends to a nearby fixed object, such as a lower railing 131 (FIG. 3A) or a platform edge 720 (FIG. 7). This feature makes reliance on vertical railing supports 130 unnecessary, thereby expanding the range of useful lockable railing trough 100 sizes and shapes. The long edge of brace 109 nearest the railing 120 may be aligned to the exterior surface of the first side of container 101. The brace 109 may be bolted to the support 104, as shown. Other methods of attachment, including formed, welded, flexible, lockable, and adjustable attachments, are also contemplated for various other embodiments. In an alternate embodiment, a plurality of sets of bolt holes are provided in the support 104 to enable changing the alignment of brace 109 for engaging different types of fixed objects. Brace 109 is shown as a rectangular bar but, in other embodiments, may be of any shape that will perform the function. Likewise, the orientation of the brace 109 may be varied in other embodiments, even to engage an upper railing instead of a lower one 131.

Figure 3A:
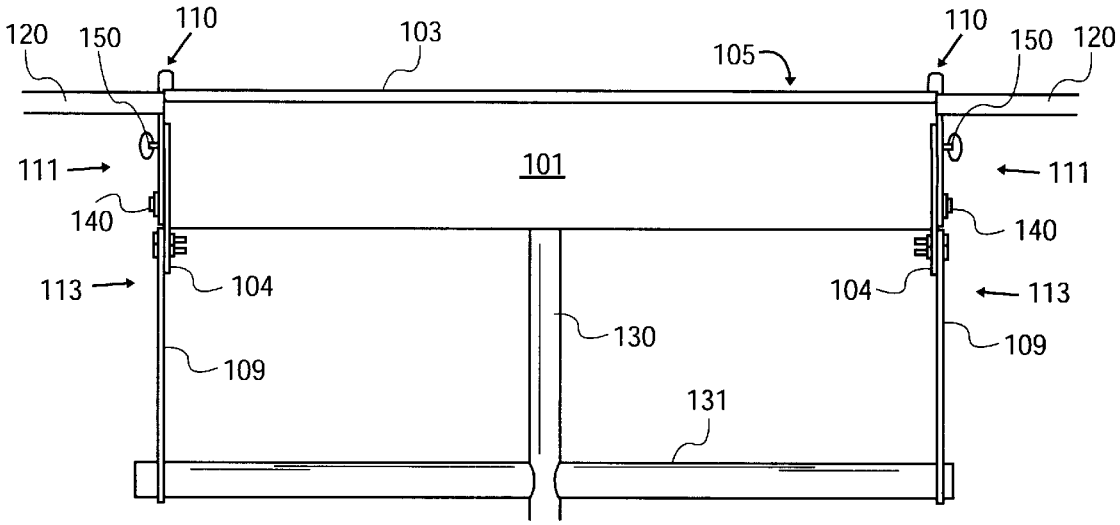
FIGS. 3A–C depict front, back, and end views of an exemplary embodiment of the lockable railing trough.

In a particular embodiment adapted to one type of man lifter, the brace 109 may be attached to the trough 105. For example, the brace 109 may be aligned and attached to the exterior of the oblique second side of the container, extending downward at the oblique angle to engage lower railing 131 (FIG. 3A). In a variation of this particular embodiment, the attachment of the brace 109 to the container 101 may be a pivot in a plane parallel to the oblique second side, allowing the brace 109 to be stored along the trough 105 side for transport, and pivoted into position while in use.

Figure 1B:
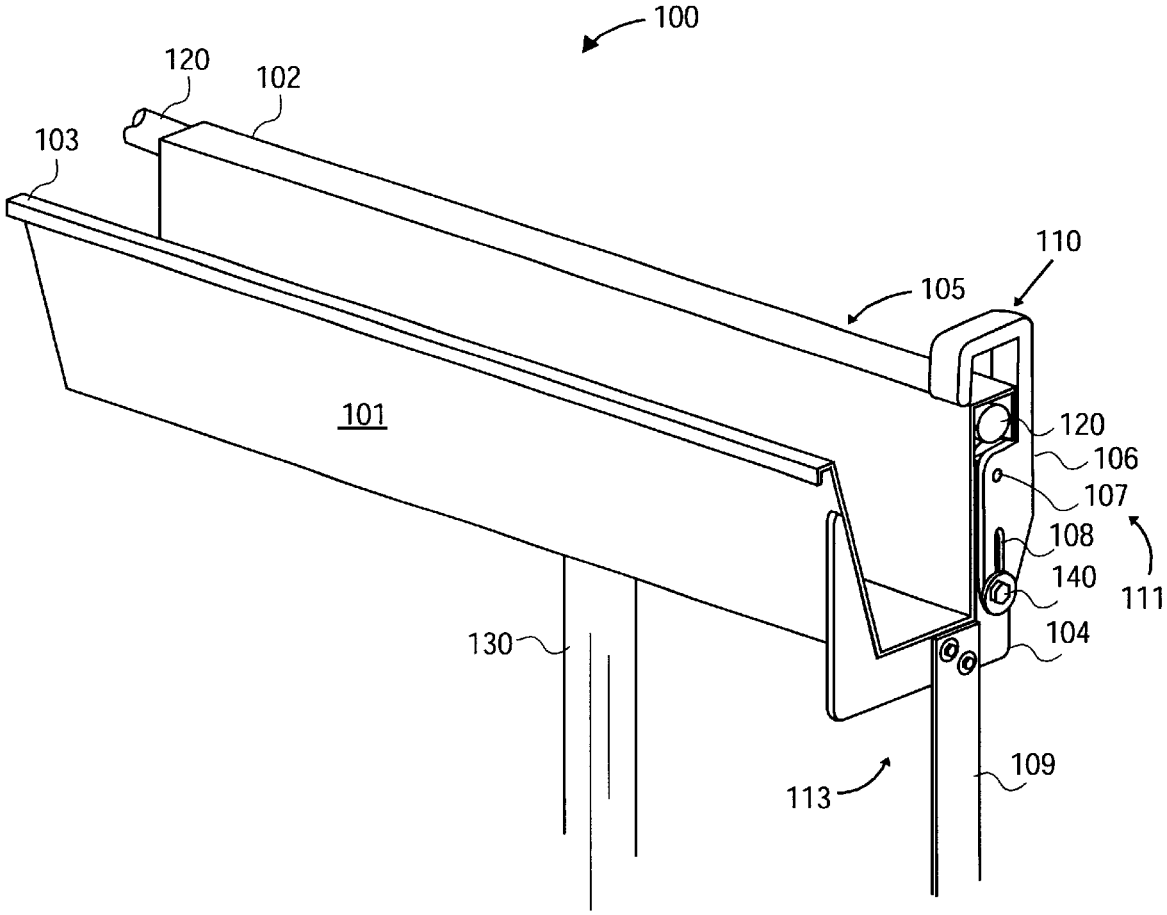
Figure 1C:
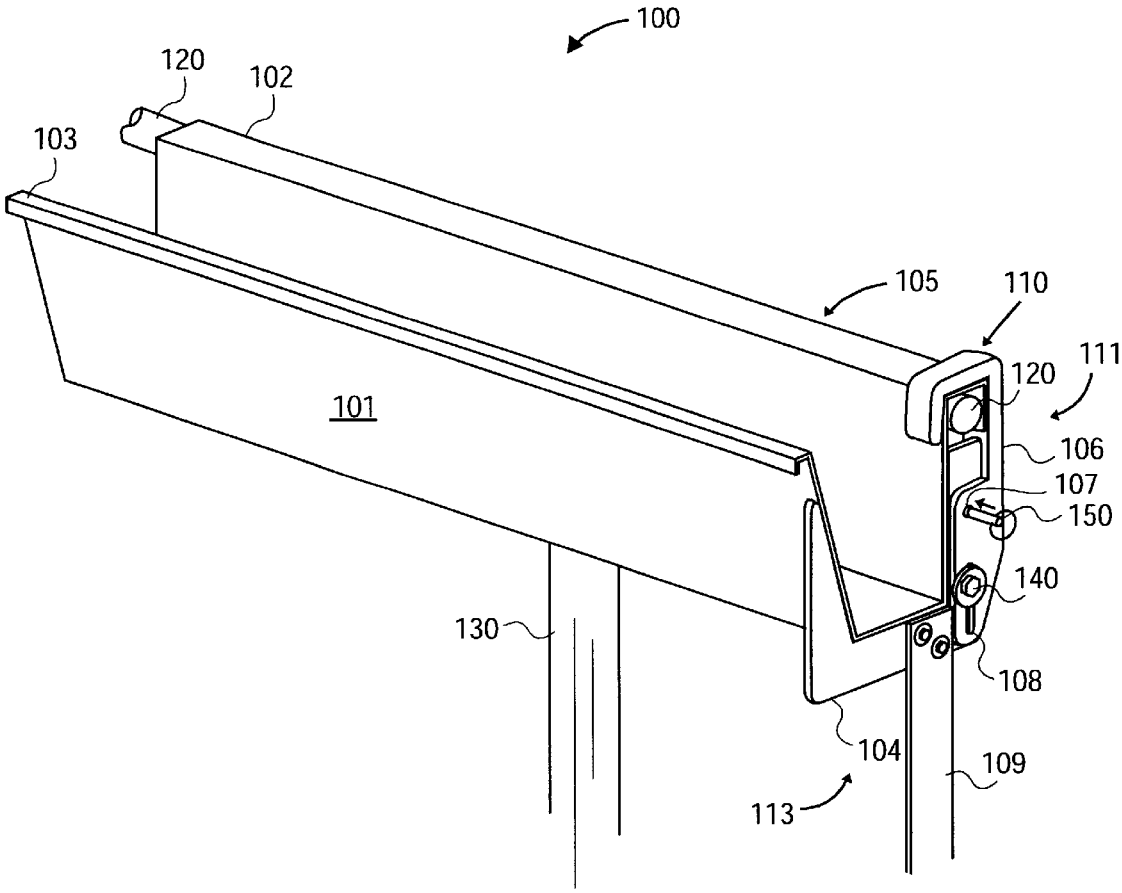

FIG. 1B shows the catch 111 rotated into an aligned position. The catch 111 has received the hook 102 by pivoting about the slider pin 140. The catch hook 110 is poised to engage the hook 102 when the catch 111 is lowered. Slider pin 140, in this embodiment 100, may be aligned directly below the center of hook 102. A wide variety of geometric relationships between the hook 102 and the slider pin 140 are contemplated as adaptations to different operational constraints and specifically adapted catch 111 designs.

FIG. 1C shows the catch 111 in the closed position. The catch hook 110 engages the hook 102, and locking pin 150 is inserted into aligned locking pin bores 107 and 117 (FIG. 1A). In this closed position, the railing 120 may not be in contact with the lock 113. However, in the event of a shock or upset to the railing 120 or railing trough 105, the railing 120 will be retained in the hook 102.

Figure 1D:
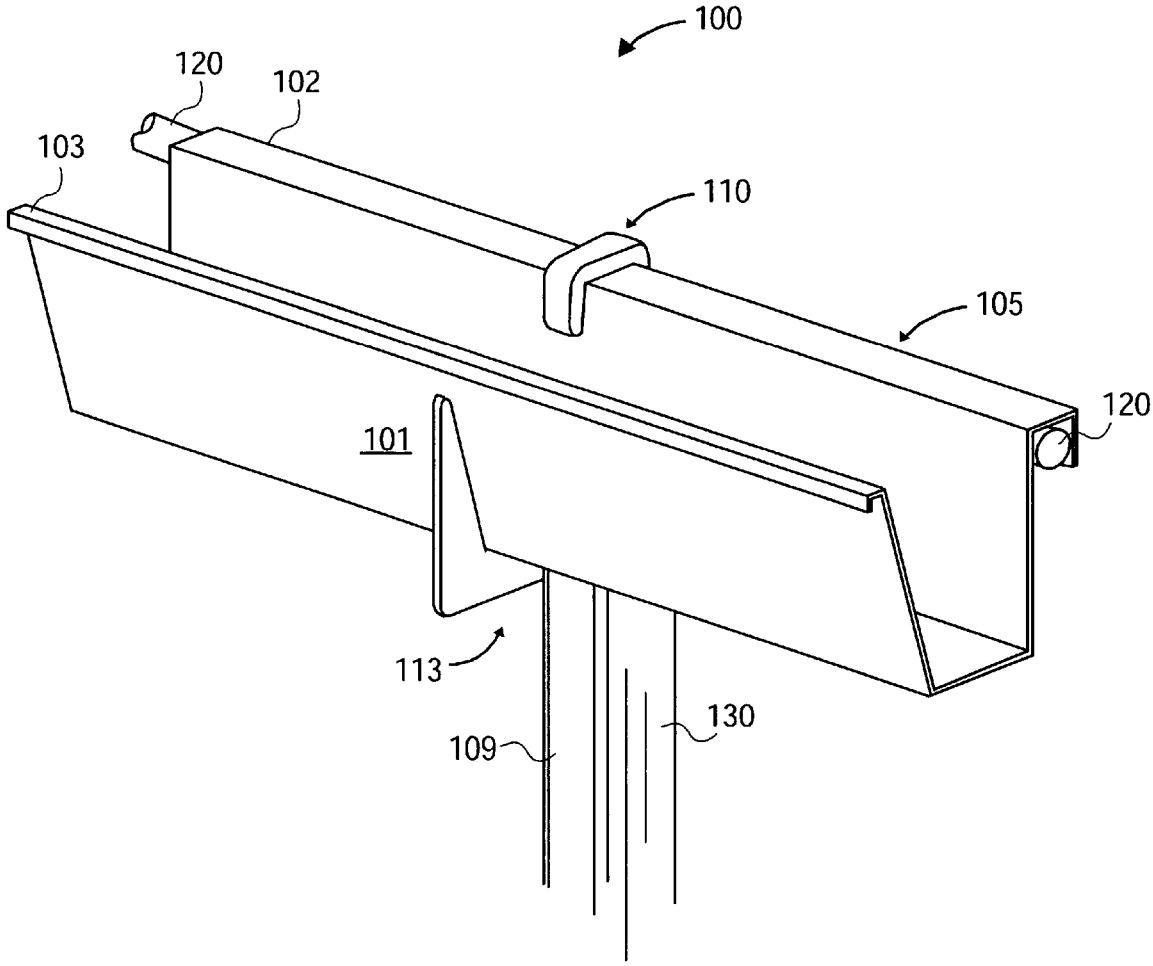

FIG. 1D shows that the lock 113 need not be installed at an end of the railing trough 105, but may be placed at any convenient point along the railing trough 105. This provides a significant advantage over locks having fixed positions on the trough 105. The advantage is in the adaptability of a trough to different railing designs and work environments, allowing the lock 113 to be placed in a convenient location. From another point of view, the precise railing configuration encountered does not impact the location of the lockable trailing trough.

It is theoretically possible that the trough 105 may move parallel to the long axis of railing 120 and thereby escape lock 113. In an embodiment, the inside surface in the crook of catch hook 110 is finished or coated to enhance frictional engagement between the catch hook 110 and the hook 102, thereby to lower the likelihood of axial disengagement of the trough 105. In other embodiments, a series of pin-receiving holes may be provided on the top surface of hook 102, to be aligned with a pin receiving hole in the catch hook 110. A pin may be inserted through both aligned holes to prevent axial disengagement of the trough 105.

In using embodiment 100, if a workman needs to get very close to a workpiece, he can place the lockable railing trough 100 on a railing 120 to his side and abut the railing-delimited workspace to the workpiece or to the nearest wall thereto. In other situations, the lockable railing trough 100 may be abutted to a wall or workpiece, and the workman will have parts and tools in front of him at his waist level.

Figure 2A:
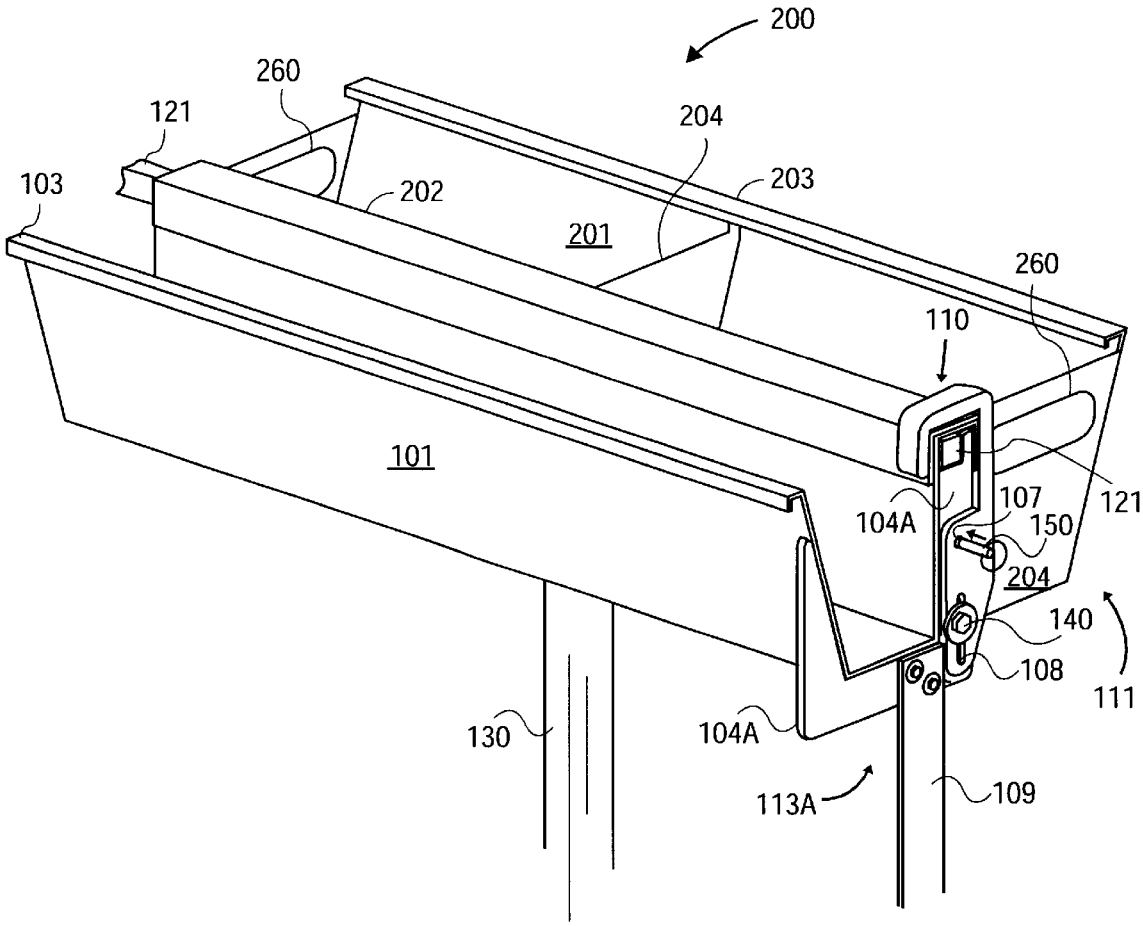
FIGS. 2A–C depict an exemplary trough and bin embodiment of the lockable railing trough on square railings.

FIG. 2A shows embodiment 200 comprising railing troughs 105 and 205, both held by a similar lock 113A. Lockable railing trough 205 is similar to lockable railing trough 105 except that the container 201 may be shorter, while the hook 202 may be the same length (See FIG. 6), but made wider to fit over hook 102. Catch hook 110 may be wider to engage hook portion 202 which engages hook 102. In a particular embodiment, catch hook 110 may be made to have an adjustable width, as is known to those of skill in the art. For example, a C-clamp configuration may be used.

FIG. 2A also shows that lockable railing trough 205 has webs 204, disposed as end panels 204, which have openings 260 that may serve as handles. "Web," as used herein, refers to a panel that is not necessarily flat, flat-sided or geometrically regular. Webs 204 may also be used as partitions 204 within the container 201, with or without openings such as 260. For example, a partition 204 may segregate small parts from tools in container 201. In some embodiments, partitions 204 may be temporary or may be user-reconfigurable. Troughs 205 with end webs 204 are also referred to as bins.

The lip 203 is bent inward, showing that variations of lip configuration, including no lips 103 and 203, are contemplated within the invention. In other embodiments, the lips 103 and 203 may be curved, otherwise shaped, or modified to adapt to the needs of particular users.

Also depicted in FIG. 2A is a railing 121 that is both square in cross section and significantly smaller than the width of hook 102. Support 104A has been adapted to include a portion just below and a portion beside the railing 121, as shown. Thus support 104A extends up into the crook of hook 102. This configuration limits the movement of the lockable railing troughs 105 and 205 in the event of a mechanical shock. However, support 104A is not normally in contact with railing 121.

Figure 2B:
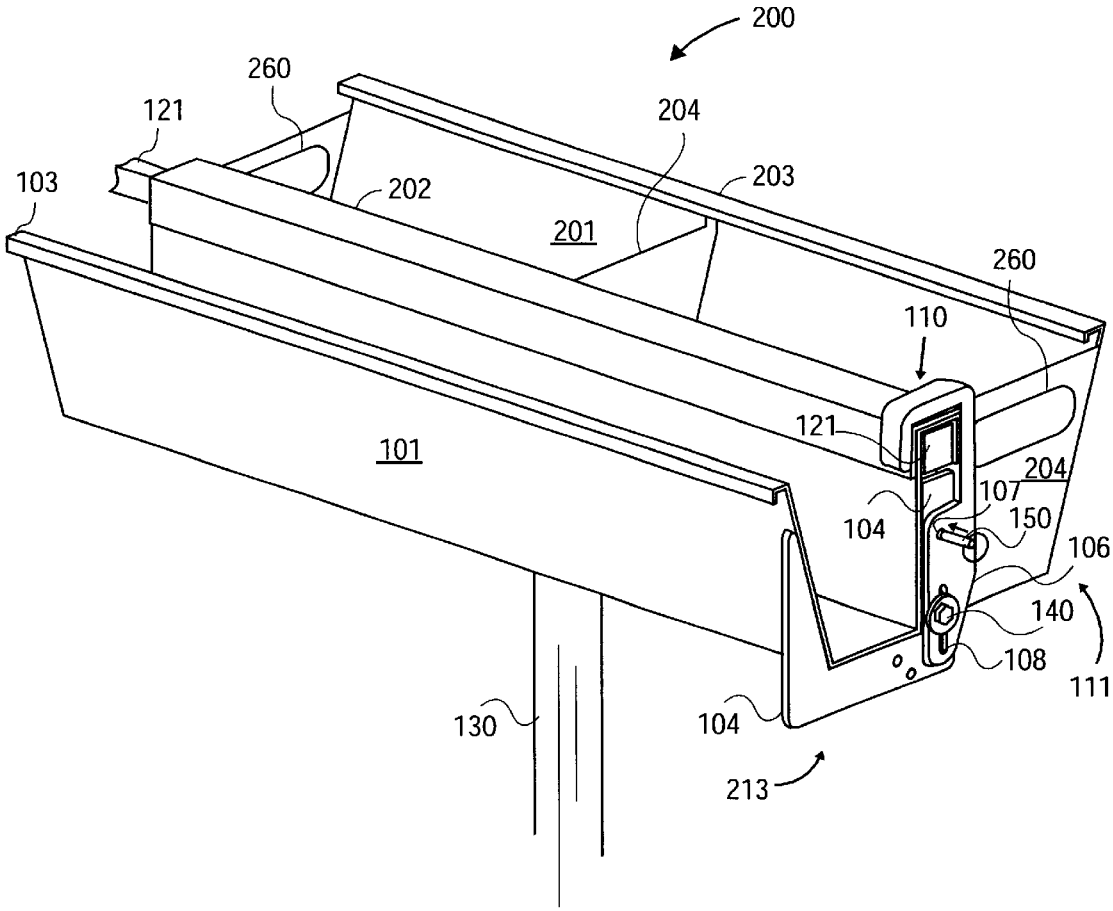

FIG. 2B shows a variation of FIG. 2A using lock 113 for a square railing fully engaged by hook 102. Any shape of railing may be engaged by hook 102. Rather than directly bind or clamp the railing 121, lock 113 merely sets a constraint on the relative position of the railing 121 and the hook 102.

Figure 2C:
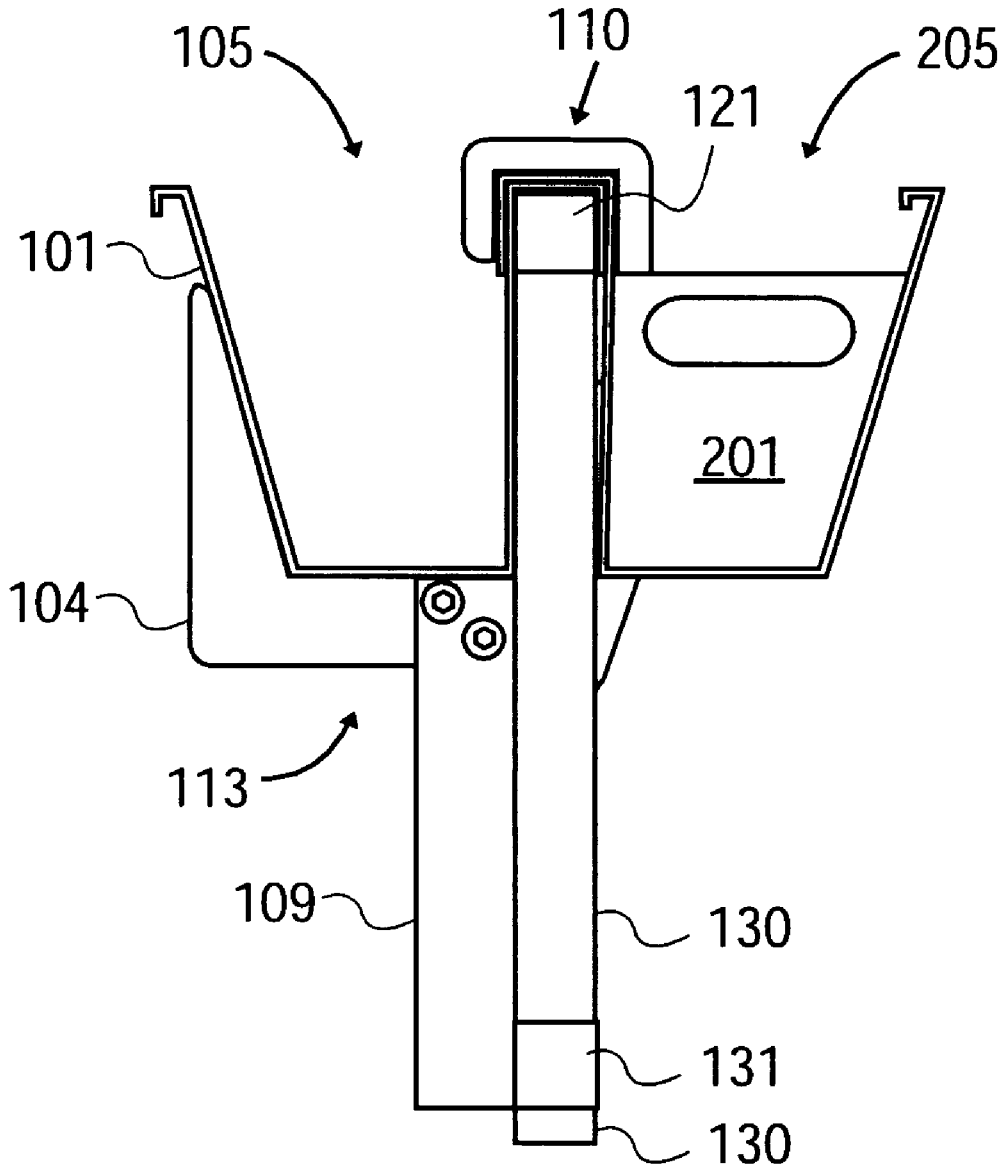

FIG. 2C shows an end view of the two-trough configuration. Trough 105 is supported by support 104 of lock 113. Brace 109 is aligned to the wall of trough 105 nearest the square railing 121 and extends to engage lower square railing 131. The lock 113 also secures trough 205 by engaging its hook portion 202 (FIG. 2A). Either or both troughs 105 and 205 may additionally be braced by a vertical railing support 130, but this is not required. (See FIG. 7).

FIG. 3A shows a front view of an exemplary embodiment of a trough 105 having two locks 1 13. Braces 109 contact lower railing 131 for support. In situations where no lower railing 131 is available, braces 109 may extend further downward to engage an edge of a platform floor 720 (FIG. 7). In many embodiments, one lock 113 is sufficient. In some embodiments, where the flexibility of the trough 105 may allow the hook 102 to disengage from the railing 120 (FIG. 1A) at one end of the trough 105 in response to a mechanical shock, two locks 113 may be used. As an alternative, placing the lock 113 at the middle of the trough 105 may provide sufficient constraint. Likewise, having two locks drastically reduces the possibility that the trough 105 will axially disengage from both locks. Axial disengagement occurs when the hook 102 slides along the railing 120 and out from under the lock 113 in reponse to an impulsive force such as in a collision. With two locks, axial disengagement from one lock further inserts hook 102 into the catch hook 110 of the second lock 113. Locks 113 may be moved inwardly from the edge positions shown in FIGS. 3A and 3B to further lessen the possibility of axial disengagement. Vertical railing support 130 need not be engaged by container 101, and so need not be present (See FIG. 3C).

Figure 3B:
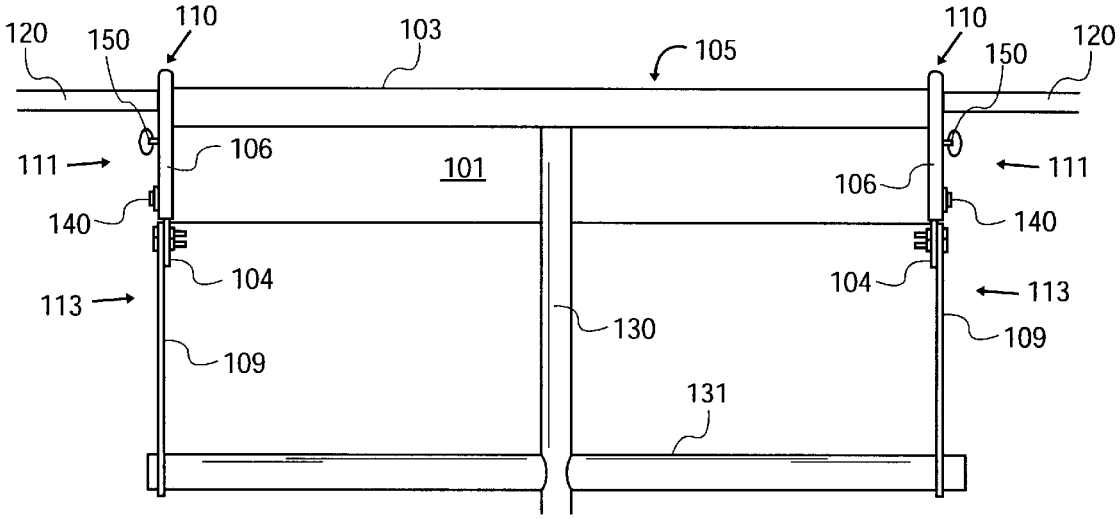
Figure 3C:
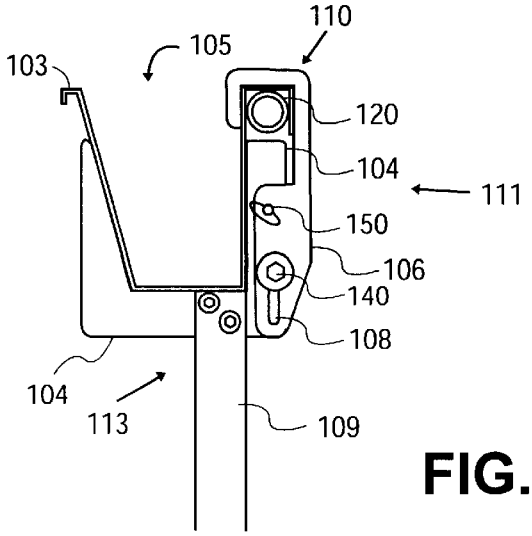

FIG. 3B shows a rear view of an exemplary embodiment of a trough 105 having two locks 113. Hook 102 completely covers railing 120 (FIG. 3C). A vertical railing support 130 may be present to support railing 120, but is not part of the invention. Trough 105 does not rely on support from railing support 130 because brace 109 engages lower railing 131 to prevent rotation of trough 105 about railing 120.

FIG. 3C shows an end view of an exemplary embodiment of a trough 105 having two locks 113 (one shown in this view). Support 104 may not directly contact the railing 120. Likewise, lock 113, as shown, does not clamp the railing 120. Hook 102 (FIG. 1A) may engage railing 120 at three points. When engaging a smaller diameter railing 120, a shim may be used between the railing 120 and the interior surface of hook 102, the shim substituting for the under-hook extension of support 104 shown in FIG. 2A.

In another alternate embodiment, the portions of support 104 engaging the bottom and second side may be omitted, and the portion of support 104 and the brace 109 are vertically aligned proximate the trough 105, with the brace 109 curving at a lower point to align with the lower railing 131. In this embodiment, the support 104 may engage only the exterior of the first side of the container 101 (FIG. 3B). In a variation of this embodiment, the support 104 does not engage the container 101 surfaces at all, the lock 113 exerting all of the torque from the brace 109 on the hook 102 through catch hook 110.

Figure 4:
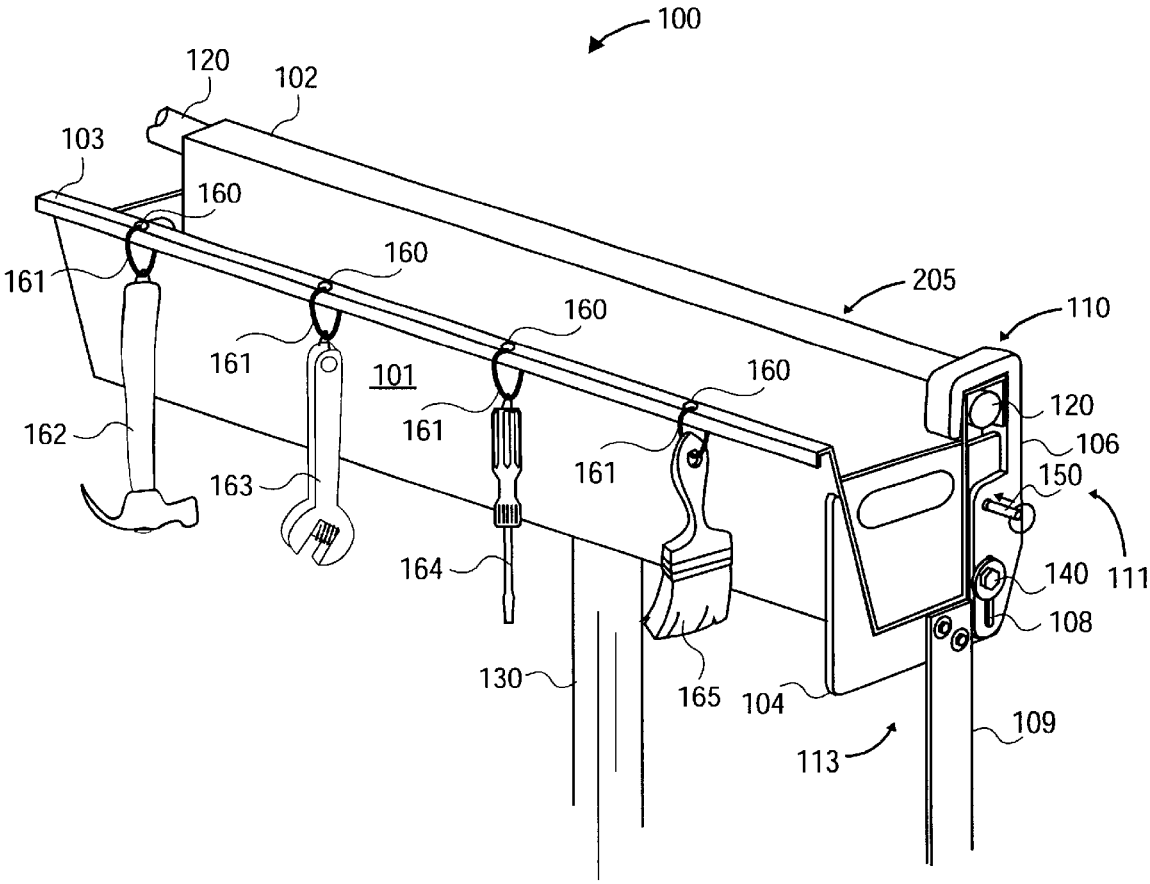
FIG. 4 depicts an exemplary bin embodiment of the lockable railing trough with tool lanyards.

FIG. 4 illustrates securing exemplary tools 162–165 to openings 160 in lip 103 using tethers 160. Conventionally, the tools 162–165 would remain in the bin 205 when not in use, but are shown outside the bin 205 for the sake of illustration. In most embodiments, the tethers 160 are long enough to allow use of the tools 162–165 without disconnecting the tethers 161 from the lip 103. In some alternate embodiments, holes 160 may engage articulated pins, as are known in the art of cufflinks, the pins attached to the tethers 161 to secure the tools 162–165 from falling. In a particular embodiment for a trough 105 (FIG. 1A), a bean bag or similar conformable weight may be tethered to the lip 103, for use weighting down conduit or other parts to keep them in place.

Figure 5:
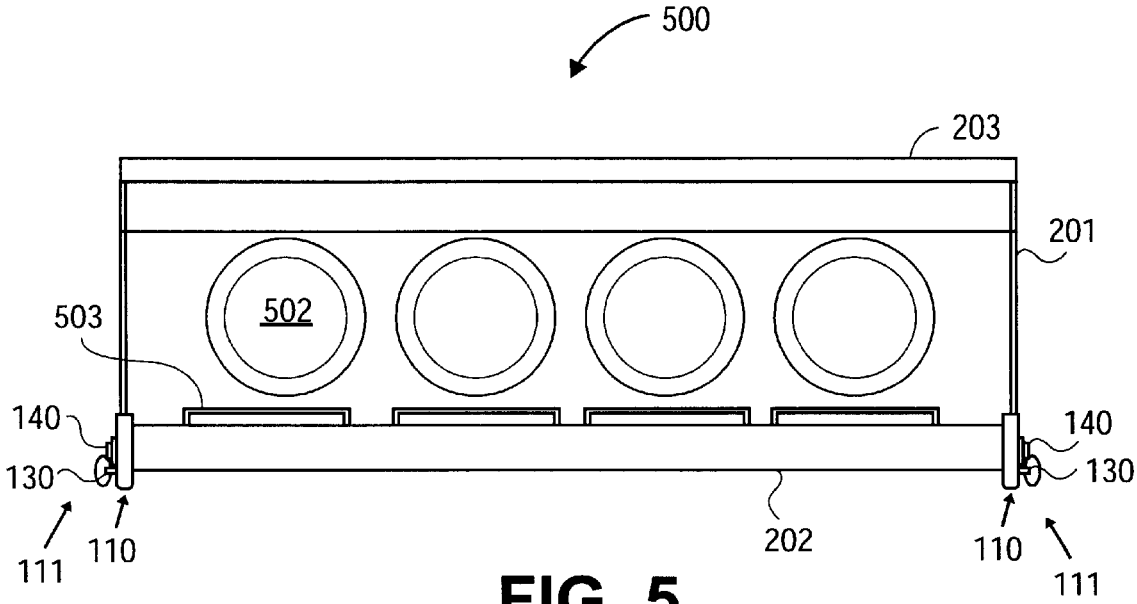
FIG. 5 depicts another exemplary bin embodiment of the lockable railing trough adapted for paint cans and lids.

FIG. 5 shows an exemplary bin 500 having adaptations 502 in the bottom of the container 201 for holding paint cans and further adaptations 503 on the interior surface of the first wall of container 201 to hold paint can lids. The adaptations 502 comprise flat annular surfaces at inwardly descending elevations and having diameters adapted to receive paint cans. Similar adaptations may be made for containers 201 adapted for use in other trades, such as for propane cylinders, spackling cans, etc. Lid holders 503 may also be adapted for the lids of other types of cans, bottles, etc.

Figure 6:
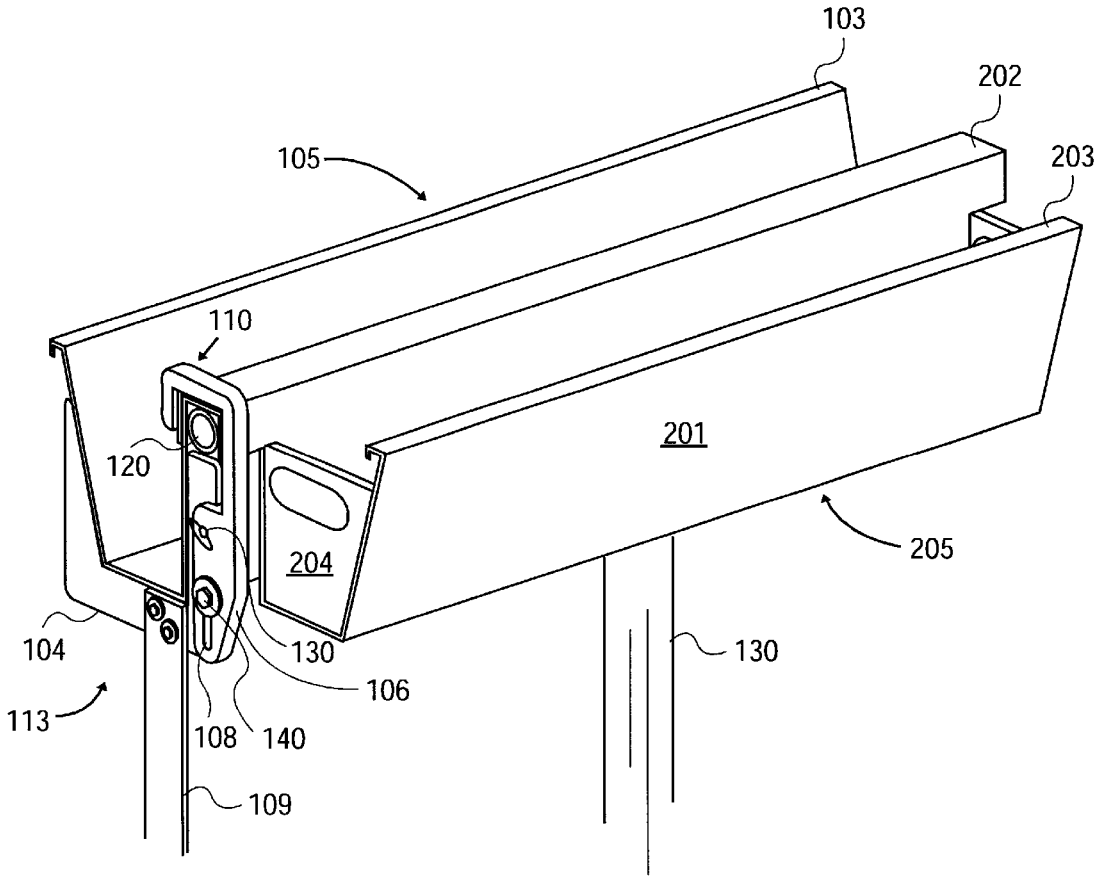
FIG. 6 depicts a bin-side view of another exemplary bin and trough embodiment of the lockable railing trough.

FIG. 6 shows a rear view of an exemplary trough 105 and bin 205 embodiment. The hook 202 extends beyond the ends of container 201 to allow lock 113 to engage hook 202. Hook 202 fits over hook 102 (FIG. 1A), allowing the lock 113 to engage hook 202 from the opposite side from that used if bin 205 where used alone. Because the railing 120 is still limited by lock 113 to stay within hooks 102 and 202, there is no loss of effectiveness in attaching to the opposite side. The positions of bin 205 and trough 105 may be reversed, with the trough 105 having trough hook 102 extensions adapted to overlap bin hook 202.

In an unusual alternate embodiment, a hole for receiving lock 113 may be cut in the bottom of bin 205, allowing the lock to be installed in a middle position through the bin. This unusual embodiment prevents axial disengagement of the bin 205 from the railing 120.

FIG. 7 shows the platform 720, or floor 720, of a man lifter, together with railings, including circumferential railings 120 and 131. Trough 105 and bin 205 are secured to railing 120 by lock 113, in the manner previously discussed. Brace 109 contacts lower railing 131 to limit rotation of the trough 105 and bin 205 about railing 120. In an alternate embodiment, brace 109 may be secured to lower railing 131 by a clamp, tie, or similar separate or integral constraints to prevent rotation in either direction. Bin 205 is shown holding tools 760 while trough 105 holds parts 710, such as pipe 720 or electrical conduit 720. In a particular embodiment, a resilient member may be connected to the lip 103 (FIG. 1A) of trough 105 or the hook 102 (FIG. 1A) configured to secure parts 710 in the trough 105. The resilient member may be an elastic cord or a spring.

Bin 205 and trough 105 may be made in any length, although 6 feet has proven to be sufficient for most purposes. In a particular embodiment, the length of the container 101 or 201 may exceed the length of the railing 120. All possible configurations and sizes of troughs 105 and bins 205 on one or more railings 120 or 131 are contemplated within the present invention. For example, a deep (i.e., 3 feet) bin 205 that has approximately equal short length and width (i.e., 9 inches) may be used to contain long-handled tools 760 in a vertical orientation. For further example, the trough 105 and bin 205, each with its own lock 113, may be on opposite sides of circumferential railing 120 and both be hung to the outside or both hung to the inside of the railings. For yet another example, a series of shorter bins 205 and troughs 105, each or pair-wise with their own locks 113, may substitute for the longer bin 205 and trough 105. The depth of troughs 105 and bins 205 should be limited to avoid the necessity of the workman bending over the railing 120 to retrieve the contents. The workman's center of mass should remain over the man lifter floor 720 (FIG. 7) at all times. A deep trough 105 might be used to hold large items such as air conditioning filters or panes of glass.

Trays and compartments, as are known in the art of tool boxes, adapted to the bins 205 and troughs 105 of the present invention, are contemplated within the present invention.

The foregoing description has described selected embodiments of a lockable railing trough. While the invention has been particularly shown and described with reference to selected embodiments thereof, it will be readily understood by one of ordinary skill in the art that, as limited only by the appended claims, various changes in form and details may be made therein without departing from the spirit and scope of the invention. For example, integrating hooks 102 and 202 into a single unit hinged axially, wherein the containers 101 and 201 may be rotated closed along the axial hinge to form a tool/parts box which can be opened into a "saddle bag" configuration over a railing and subsequently locked thereon, is contemplated within the present invention. For further example, uses for containing objects other than tools and parts are contemplated, as such for a snack-vendor's wares on a railing in a sports arena or a parade barricade railing, local ordinances permitting. For further example, uses on objects other than railings, such as taut cables, fences, ladders, and plumbing pipes are contemplated. For another example, the container 101 and hook 102 may be curved adaptively to a curved railing 102.

I claim:

1. A lockable railing trough comprising:

a container comprising:

a trough portion; and a hook portion, the hook portion extending from a side of the trough, the hook portion adapted to engage at least one length of railing, the hook portion substantially aligned to the trough portion; and a lock, the lock adapted to releasably engage the container, the lock operable to close without contacting the railing, the lock operable in a closed position to prevent the hook portion from disengaging from the railing.

2. The lockable railing trough of claim 1, wherein a side of the trough portion comprises a side oblique to the a bottom of the trough.

3. The lockable railing trough of claim 1, further comprising a lip, the lip comprising a shaped portion of an edge of a side of the trough.

4. The lockable railing trough of claim 1, further comprising at least one partition, the at least one partition comprising at least one web, the web engaging portions of interior surfaces of at least one of the bottom of the trough, a first side of the trough, and a second side of the trough.

5. The lockable railing trough of claim 4, wherein the at least one web comprises at least one end of the trough.

6. The lockable railing trough of claim 5, wherein the at least one web comprises at least one opening.

7. The lockable railing trough of claim 1, wherein the hook portion and the trough portion comprise a single shaped sheet of material.

8. The lockable railing trough of claim 7, wherein the shaped sheet of material comprises a plurality of substantially mutually parallel angular bends.

9. The lockable railing trough of claim 7, wherein the material comprises at least one of metal, plastic, fiberglass, and a composite material.

10. The lockable railing trough of claim 1, wherein the engagement of the hook portion of the container with the railing comprises contact between at least one surface of the railing and at least a portion of at least one interior surface of the hook portion, the lock operable to prevent the railing from making simultaneous contact with the lock and all of the at least a portion of the at least one interior surface of the hook portion.

11. The lockable railing trough of claim 1 wherein the lock comprises:

a support, the support comprising a substantially rigid panel, the panel sized and shaped to engage at least a portion of at least one exterior surface of the container; and a catch, the catch comprising a catch hook moveably connected to the support and manipulatable between an open position and a closed position, the catch hook sized and shaped to receive the hook portion of the container and to engage the hook portion of the container in the closed position of the catch.

12. The lockable railing trough of claim 10, wherein the lock further comprises a brace, the brace comprising an elongated substantially rigid member fixed to the support, the brace adapted to brace against at least one rigid object in proximity to the railing.

13. The lockable railing trough of claim 10, wherein the connection between the support and the catch comprises:

a slider pin, the pin fixed to a portion of the support that engages a first side of the trough beneath the hook; and a slider slot, the slider slot comprising an elongated bore transverse through the catch, the slot slidingly engaging the slider pin.

14. The lockable railing trough of claim 12, further comprising:

a first locking pin bore, the first locking pin bore transversely though a portion of the support that engages the first side of the trough beneath the hook;

a second locking pin bore in the catch, the second locking pin bore aligning with the first locking pin bore in the closed position of the catch; and a locking pin, the locking pin sized and shaped to be inserted through the first and second locking pin bores.

15. The lockable railing trough of claim 10, wherein the catch further comprises:

a body, the body comprising at least one substantially rigid panel.

16. The lockable railing trough of claim 1, further comprising a brace, the brace comprising an elongated substantially rigid member attached to the container, the brace adapted to engage a fixed object in proximity to the railing, operable to constrain rotation of the container about the railing.

17. The lockable railing trough of claim 15, wherein the attachment of the brace to the container comprises at least one of a moveable attachment, a lockable attachment, and an adjustable attachment.

18. The lockable railing trough of claim 1, being the first lockable railing trough, further comprising a second lockable railing trough, the second lockable railing trough comprising a length of hook portion extending longitudinally beyond at least one end of the trough portion by a length sufficient to be engaged by the lock, the hook portion of the container adapted to engage a length of a hook portion of the first lockable railing trough.

19. An lockable railing trough comprising:

a container comprising:

a trough portion; and a hook portion, the hook portion extending from the trough, the hook adapted to engage and suspend from a length of railing, the hook portion aligned to the trough portion; and a lock, the lock configured to releasably attach to the container, the lock having a closed position, the lock in the closed position operable to prevent the hook portion from disengaging from the railing;

wherein the lock comprises a support and a catch, the support engaging the trough portion, the catch moveably attached to the support, the catch comprising a body and a catch hook, the catch hook sized and shaped to receive and engage the hook portion of the container, the catch manipulatable between the closed position and an open position and wherein the lock is operable to prevent the railing from simultaneously contacting the support and a portion of the hook engaged in suspension.

20. The lockable railing trough of claim 18, wherein the hook portion and the trough portion comprise a single shaped sheet of material.

21. The lockable railing trough of claim 19, wherein the shaped sheet of material comprises a plurality of mutually parallel angular bends.

22. The lockable railing trough of claim 19, wherein the material comprises at least one of metal, plastic, fiberglass, and a composite material.

23. The lockable railing trough of claim 18 wherein the lock further comprises:

a support, the support comprising a substantially rigid panel, the panel sized and shaped to engage at least two exterior surfaces of the trough;

a catch, the catch moveably connected to the support and manipulatable between an open position and a closed position, the catch operable in the closed position to prevent the hook portion from disengaging from the railing.

24. The lockable railing trough of claim 22, wherein the lock further comprises a brace, the brace comprising an elongated substantially rigid member, fixed to the support, the brace sized and shaped to engage at least one of a second railing or a platform edge.

25. The lockable railing trough of claim 22, wherein the moveable connection between the support and the catch comprises:

a slider pin, the pin fixed to a portion of the support that engages a first side of the trough beneath the hook portion; and a slider slot, the slider slot comprising an elongated bore transverse through the catch, the slot slidingly engaging the slider pin.

26. The lockable railing trough of claim 24, further comprising:

a first locking pin bore, the bore transversely though a portion of the support that engages the first side of the trough beneath the hook;

a second locking pin bore in the catch, the second locking pin bore aligning with the first locking pin bore in the closed position of the catch; and a locking pin, the locking pin sized and shaped to be inserted through the first and second locking pin bores.

27. The lockable railing trough of claim 22, wherein the catch comprises:

a body, the body comprising at least one substantially rigid panel and a catch hook, the catch hook extending from the body, the catch hook sized and shaped to receive the hook portion in a rotated position of the catch and to engage the hook portion of the container in the closed position of the catch.

28. A lockable railing trough comprising:

an elongated container, the container comprising a constant cross-sectional shape for most of its length, the container adapted to independently engage and suspend from an elongated member; and a mechanism, the mechanism comprising substantially rigid materials, the mechanism adapted to the constant cross-sectional shape of the container and engaging the container along a length having a constant cross-sectional shape, the engaged mechanism operable to prevent the elongated member from being simultaneously in contact with the mechanism and a portion of the container engaged in suspension.

29. The lockable railing trough of claim 28 wherein the engagement between the container and the mechanism is further operable to prevent rotation of the container about the elongated member in at least one rotational direction.

30. The lockable railing trough of claim 28 wherein the container comprises a single sheet of material having a plurality of mutually parallel bends.

31. A method of retaining a container on a railing, the method comprising the steps of:

engaging the railing with a hook portion of the container;

engaging at least three surfaces on the container with a lock; and avoiding engagement of the railing with the lock.

32. The method of claim 31, further comprising the step of:

engaging a fixed object with a brace, the brace further engaging at least one of the lock and the container.

33. A method of making a lockable railing trough, the method comprising the steps of:

shaping and sizing a single sheet of material into a trough having a hook portion;

shaping and sizing a support to engage exterior surfaces of the trough;

shaping and sizing a catch, the catch comprising a catch hook, the catch hook shaped and sized to receive and engage the hook portion; and connecting the catch to the support with a moveable connection.

34. The method of claim 33, wherein the step of shaping a sheet of material comprises at least one of bending, stamping, casting, and forming.

35. The method of claim 33, further comprising the step of drilling a locking pin bore through the catch and the support.

36. The method of claim 33, further comprising the step of attaching a brace to at least one of the support and the container.

37. A lock for a lockable railing trough, comprising:

a support, comprising:

substantially rigid material sized and shaped to engage a bottom and two sides of a lockable railing trough;

at least one slider pin extending perpendicularly from at least one side of the support;

a locking pin bore through the support; and a catch, comprising:

a body, comprising at least one slider slot, sized and shaped to engage the at least one slider pin;

at least one locking pin bore through the body, the at least one locking pin bore through the body positioned to align with the locking pin bore in the support in a closed position of the catch;

a catch hook the catch hook sized and shaped to receive and lockably engage a hook portion of a lockable railing trough; and a brace attached to the support, the brace comprising substantially rigid material sized and shaped to engage a rigid object to constrain rotation of the lockable railing trough about a railing.

38. The lock of claim 37, wherein the lock is sized and shaped to prevent the railing from simultaneously contacting the support and all interior surfaces of a hook portion of the lockable railing trough.

* * * * *